US010796611B2

(12) United States Patent
Barnes

(10) Patent No.: US 10,796,611 B2
(45) Date of Patent: Oct. 6, 2020

(54) DRIVE-THROUGH ORDER POINT

(71) Applicant: Michael S. Barnes, Marietta, GA (US)

(72) Inventor: Michael S. Barnes, Marietta, GA (US)

( * ) Notice: Subject to any disclaimer, the term of this patent is extended or adjusted under 35 U.S.C. 154(b) by 0 days.

(21) Appl. No.: 15/274,563

(22) Filed: Sep. 23, 2016

(65) Prior Publication Data

US 2018/0090036 A1 Mar. 29, 2018

(51) Int. Cl.

| | |
|---|---|
| ***G09F 7/18*** | (2006.01) |
| ***G09F 13/22*** | (2006.01) |
| *H04R 1/02* | (2006.01) |

(52) U.S. Cl.

CPC ..... *G09F 7/18* (2013.01); *G09F 13/22* (2013.01); *G09F 2007/1843* (2013.01); *G09F 2007/1856* (2013.01); *G09F 2013/222* (2013.01); *H04R 1/026* (2013.01); *H04R 1/028* (2013.01)

(58) Field of Classification Search

CPC ..... G09F 15/0081; G09F 15/0037

USPC ..... 40/392, 493, 502, 503, 506, 747; 292/251.5

See application file for complete search history.

(56) References Cited

U.S. PATENT DOCUMENTS

| | | | | |
|---|---|---|---|---|
| 1,448,664 | A * | 3/1923 | Hull | G09F 7/22 211/169 |
| 5,390,719 | A * | 2/1995 | Barnes | E04H 14/00 160/10 |
| 2003/0159320 | A1* | 8/2003 | Lanci | G09F 7/22 40/493 |
| 2011/0010972 | A1* | 1/2011 | Venetucci | G09F 11/02 40/502 |
| 2011/0298604 | A1* | 12/2011 | Peerali | E01F 13/02 340/436 |
| 2013/0049382 | A1* | 2/2013 | Day | E05C 19/16 292/251.5 |

* cited by examiner

*Primary Examiner* — Joanne Silbermann
(74) *Attorney, Agent, or Firm* — Michael F. Krieger; Kirton McConkie

(57) ABSTRACT

An order point can be employed in a drive-through or similar setting. The order point can have one or more rotatable menu cases. Each rotatable menu case can include two opposing sides that are equally configured to display a menu. The menu case can be mounted to the order point in a manner that allows either side of the menu case to be rotated into a forward facing position. The menu case can also include angle stops which limit the range of rotation of the menu case and retain the menu case in the forward facing positions. The order point may also include a pivoting canopy which functions to shade the menu cases as well as to prevent damage when a vehicle is too tall.

12 Claims, 8 Drawing Sheets

DRIVE-THROUGH ORDER POINT

CROSS-REFERENCE TO RELATED APPLICATIONS

N/A

BACKGROUND

Many businesses, such as restaurants, employ a drive-through to allow customers to receive goods or services without leaving their vehicles. When a drive-through is provided at a restaurant, the business typically employs an order point that includes a menu, a microphone, and a speaker to allow customers to place an order before arriving at the drive-through window.

When order points are employed in this drive-through context, it can be difficult to update the menu or other content that the order point displays. For example, many restaurants may provide one menu during breakfast hours and another menu during lunch and dinner hours. Various types of order points have been created to facilitate changing the menu. For example, an order point may incorporate a digital display device on which the menu is displayed. In such cases, the menu can be easily updated from inside the restaurant. However, digital display devices are typically more expensive to purchase as well as to operate and can be difficult to see in bright daylight.

For these reasons, many restaurants choose to employ static menu display cases (i.e., a lighted box that holds the menu). To accommodate a changing menu with static displays cases, the restaurant may simply add an extra menu case to the side or above the main menu case(s). Although this eliminates the need to update the display, it can also overload the customer with too many options including those that may not even be available when the customer is ordering.

BRIEF SUMMARY

The present invention extends to an order point that can be used in a drive-through. The order point can include one or more rotatable menu cases. Each rotatable menu case can include two opposing sides that are equally configured to display a menu. The menu case can be mounted to the order point in a manner that allows either side of the menu case to be rotated into a forward facing position. The menu case can also include angle stops which limit the range of rotation of the menu case and retain the menu case in the forward facing positions. The order point may also include a pivoting canopy which functions to shade the menu case(s) as well as to prevent damage when a vehicle is too tall.

In one embodiment, the present invention is implemented as an order point that includes a base, a vertical support extending upwardly from the base, first and second horizontal supports that each extend outwardly from a first side of the vertical support, the first horizontal support being spaced from the second horizontal support, and a first menu case having a first side and a second side opposite the first side. Each of the first and second sides is configured to display a menu. The first menu case is secured between the first and second horizontal supports via a rotatable connection. The first menu case includes a first angle stop that contacts the second horizontal support when the first menu case has been rotated to cause the first side to be facing forward. The first menu case may further include a second angle stop that contacts the second horizontal support when the first menu case has been rotated to cause the second side to be facing forward.

In another embodiment, the present invention can be implemented as order point comprising: a base; a vertical support extending upwardly from the base; first and second upper horizontal supports that extend from opposite sides of the vertical support; first and second lower horizontal supports that also extend from opposite sides of the vertical support; a first menu case secured between the first upper horizontal support and the first lower horizontal support via a rotatable connection, the first menu case having a first side and a second side opposite the first side, each of the first and second sides being configured to display a menu, the first menu case including a first angle stop that contacts either the first lower horizontal support or the first upper horizontal support when the first menu case has been rotated to cause the first side to be facing forward and a second angle stop that contacts either the first lower horizontal support or the first upper horizontal support when the first menu case has been rotated to cause the second side to be facing forward; and a second menu case secured between the second upper horizontal support and the second lower horizontal support via a rotatable connection, the second menu case having a first side and a second side opposite the first side, each of the first and second sides of the second menu case being configured to display a menu, the second menu case including a third angle stop that contacts either the second lower horizontal support or the second upper horizontal support when the second menu case has been rotated to cause the first side to be facing forward and a fourth angle stop that contacts either the second lower horizontal support or the second upper horizontal support when the second menu case has been rotated to cause the second side to be facing forward.

In another embodiment, the present invention can be implemented as an order point comprising: a base; a vertical support extending upwardly from the base; first and second horizontal supports that each extend outwardly from a first side of the vertical support; and a first menu case having a first side and a second side opposite the first side, each of the first and second sides being configured to display a menu, the first menu case being secured between the first and second horizontal supports via a rotatable connection, the first menu case including a first angle stop that contacts the second horizontal support when the first menu case has been rotated to cause the first side to be facing forward and a second angle stop that contacts the second horizontal support when the first menu case has been rotated to cause the second side to be facing forward, the first and second angle stops each including a magnet for securing the angle stop to the second horizontal support.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

In this specification and the claims, the term "menu" should be construed to encompass any type of information that can be displayed within a menu case. In typical embodiments, the menu will be a fast food restaurant's menu. However, the invention could equally be used in other drive-through contexts (e.g., a bank, a pharmacy, a car wash, etc.). The term "menu-board" will refer to the physical media (e.g., paper or plastic) on which the menu is printed.

Figure 1:
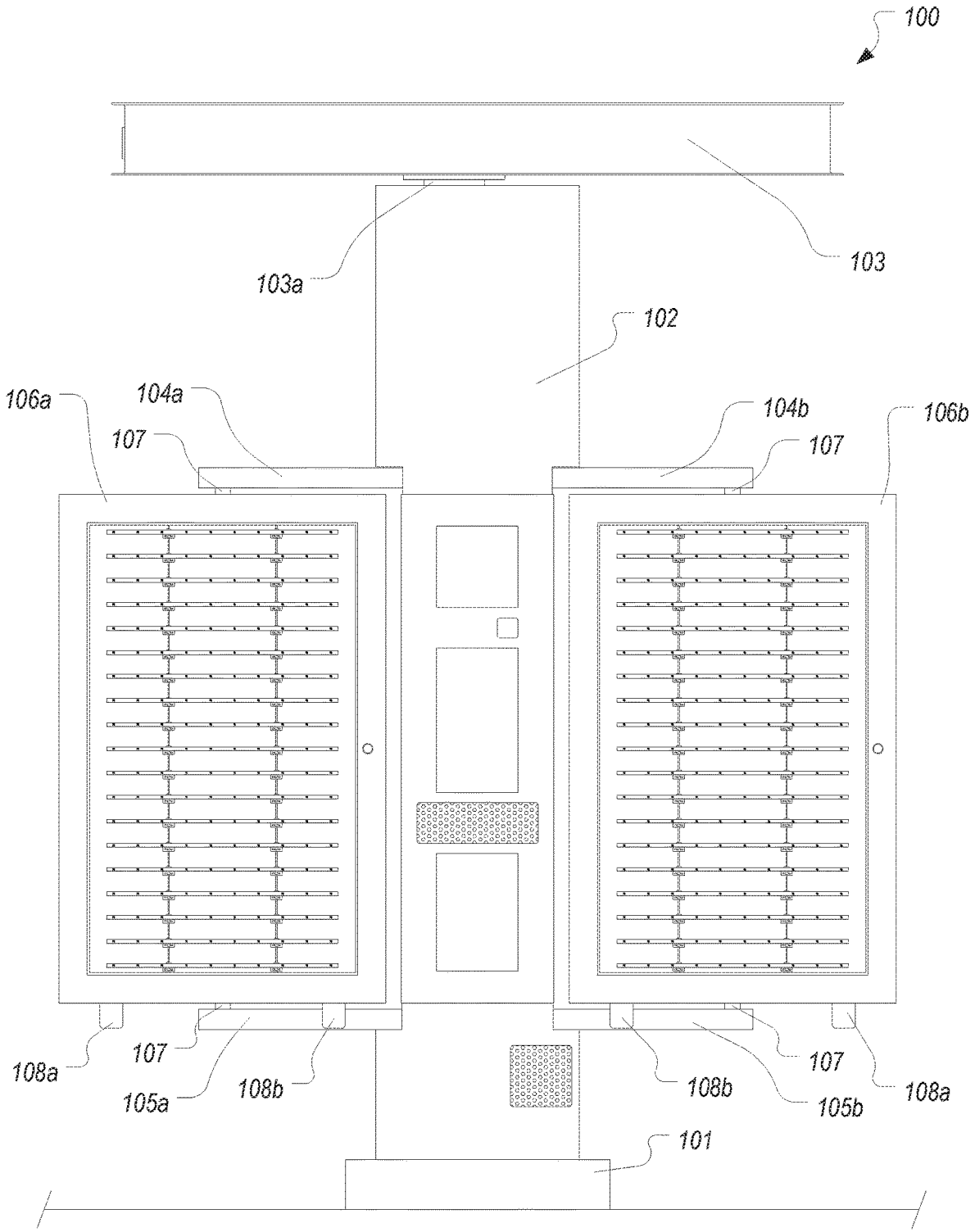
FIG. 1 provides a front view of an order point that includes two rotatable menu cases and a pivoting canopy in accordance with one or more embodiments of the present invention.

FIG. 1 illustrates an order point 100 that is configured in accordance with one or more embodiments of the present invention. Order point 100 includes a base 101, a vertical support 102, a canopy 103, upper horizontal supports 104*a*, 104*b* extending from opposite sides of vertical support 102, lower horizontal supports 105*a*, 105*b* extending from opposite sides of vertical support 102 and being spaced apart from upper horizontal supports 104*a*, 104*b*, and menu cases 106*a*, 106*b* that are secured between the horizontal supports in a rotatable fashion.

Base 101 can include various structural components (not shown) for anchoring order point 100 to the ground or other underlying structure as well as a cover for such structural components. Vertical support 102 can be coupled to base 101 (e.g., via bolts) to ensure that vertical support remains upright and can support the weight of canopy 103 and menu cases 106*a*, 106*b*. As an example, in some embodiments, base 101 and vertical support 102 can comprise internal steel structural supports (e.g., a base plate and a vertical support pylon bolted to the base plate) over which various aluminum covers are positioned to provide a more aesthetic appearance. These covers can also serve to house various electrical components such as a camera, microphone, and speaker as well as the wiring for connecting these components with a power source and/or other electrical/computer components located within the business establishment.

Canopy 103 can be coupled to vertical support 102 via a pivoting connection 103*a*. Because of pivoting connection 103*a*, canopy 103 will be able to rotate when it is struck by a vehicle. The height of canopy 103 can be set to correspond with the height of any downstream structure (e.g., an overhang above the drive-through window). In this way, canopy 103 can function to alert a driver when his or her vehicle is too tall to pass through the drive-through. Also, due to pivoting connection 103*a*, when canopy 103 is struck, it will pivot out of the way thereby minimizing the damage to the canopy as well as to the vehicle. Pivoting connection 103*a* can be biased to cause canopy 103 to return to its original position after being displaced.

Figure 3:
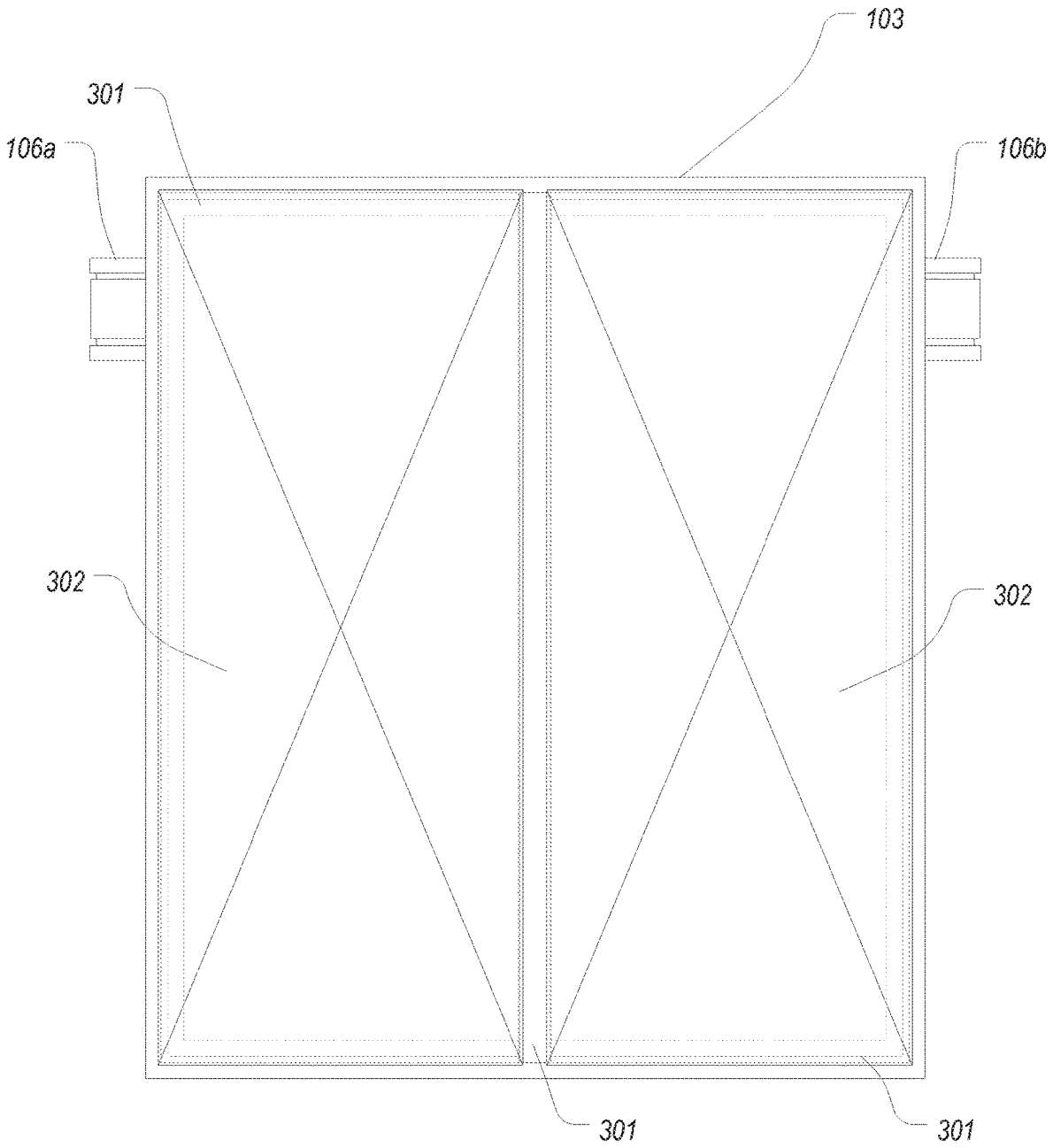
FIG. 3 provides a top view of the canopy of the order point.
Figure 4:
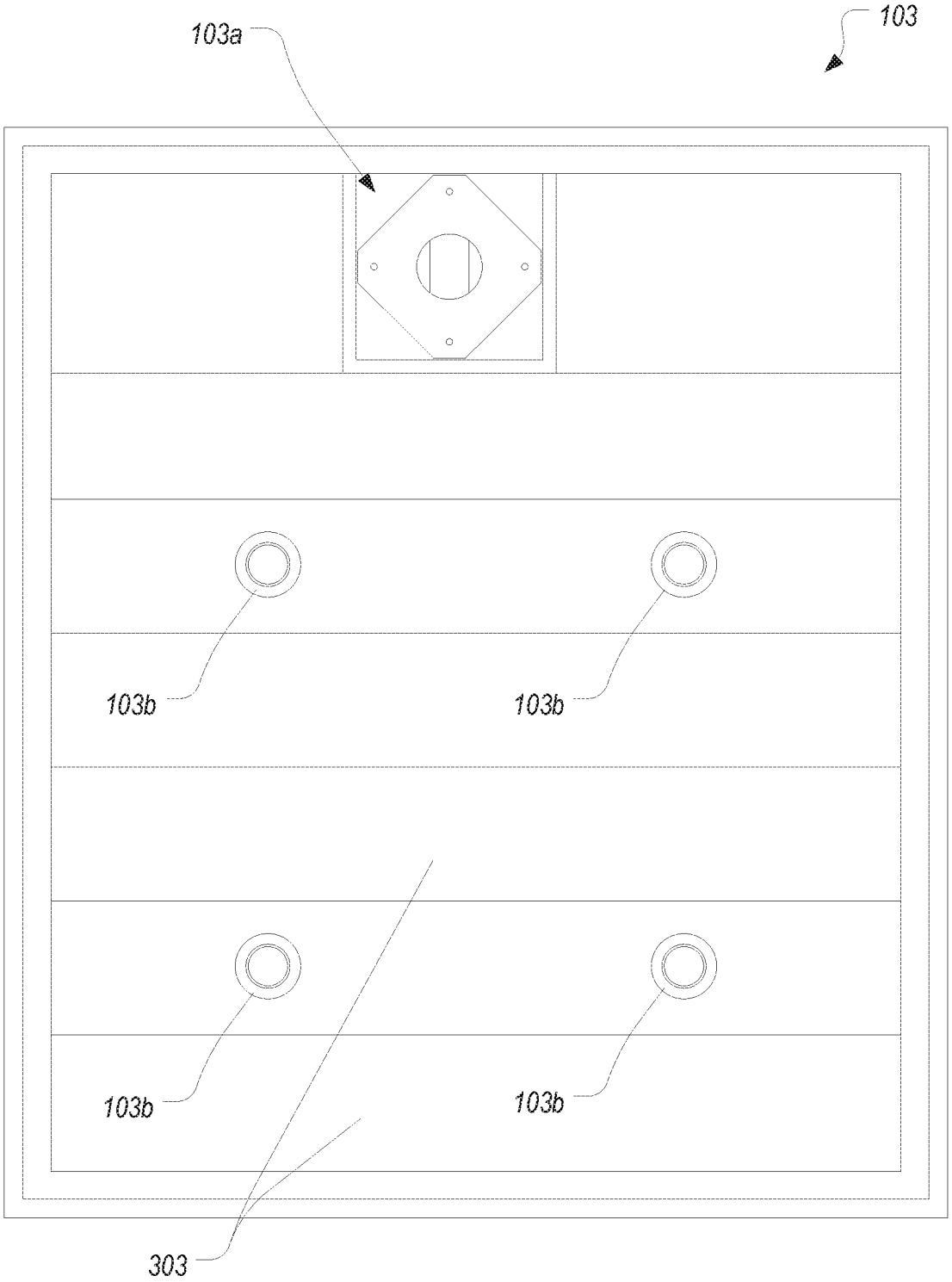
FIG. 4 provides a bottom view of the canopy of the order point.

As is best shown in FIG. 3, canopy 103 can be sized to substantially or entirely cover menu cases 106*a*, 106*b* to thereby shade the menus and to provide protection from the elements while a customer is placing an order. As shown in FIG. 4, the underside of canopy 103 can include a number of lights 103*b* to illuminate the order point when necessary. In some embodiments, canopy 103 can be formed of an aluminum c-channel structure 301, aluminum roof panels 302, and aluminum soffit panels 303 to thereby minimize the weight of the canopy. Also, in some embodiments, the side (or at least the leading side) of canopy 103 may be coated or lined with a shock absorbing material to further reduce damage that may be caused when canopy 103 is struck by a vehicle.

Returning to FIG. 1, upper horizontal supports 104*a*, 104*b* can be spaced from lower horizontal supports 105*a*, 105*b* sufficiently to accommodate menu cases 106*a*, 106*b*. As shown, menu case 106*a* can be coupled to upper horizontal support 104*a* and lower horizontal support 105*a* via posts 107, and menu case 106*b* can also be coupled to upper horizontal support 104*b* and lower horizontal support 105*b* via posts 107. Posts 107 can couple to the respective menu case at a central point of the menu case and can be configured to allow the menu case to rotate around this central point. In some embodiments, a menu case can be coupled using two posts (i.e., posts that do not extend through the menu case), or using a single post (i.e., a post that extends between the upper and lower horizontal supports). However, two posts may be preferred in many embodiments to thereby maximize the free space within the menu case.

Figure 5:
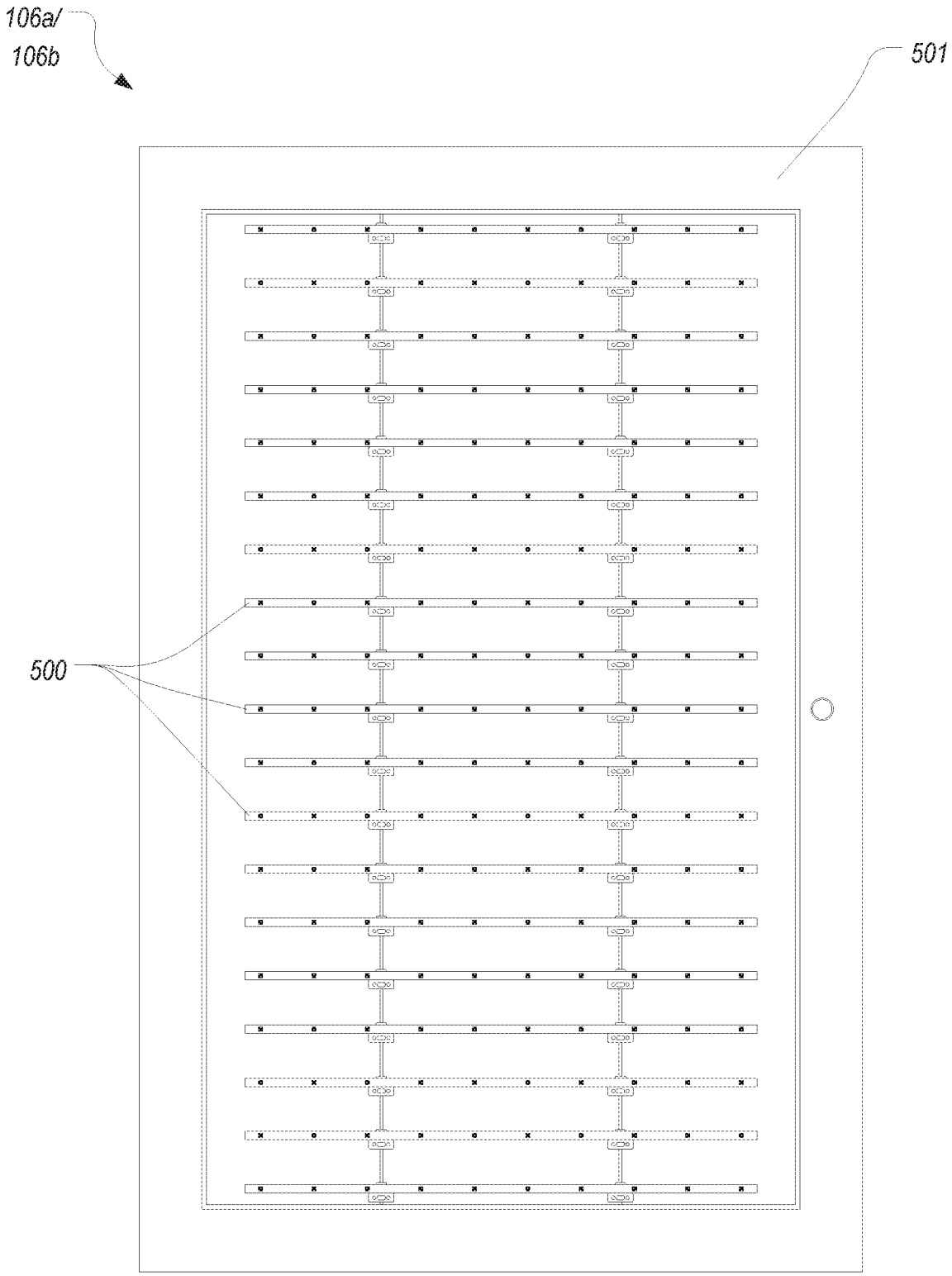
FIG. 5 illustrates a menu case in isolation.

Each of menu cases 106*a*, 106*b* can be configured in substantially the same manner on the front and back sides. With reference to FIG. 1, the visible side of each menu case can be referred to as the front side while the opposite side can be referred to as the back side. Each of these sides can be configured to house a menu-board. For example, as best shown in FIG. 5 (which can represent a view of either side of the menu case), each side can include a cover 501 (e.g., a cover that is comprised of an aluminum casing having an opening in which an acrylic sheet is secured) that can be opened to place a menu-board therein. Each menu case can also include an LED curtain 500 or other light source that extends vertically within a center of the menu case to thereby provide illumination to both sides of the menu case.

Menu cases 106*a*, 106*b* can be rotated around posts 107 to cause either the front or back side of the menu case to face forward (i.e., towards the customer). This ability to rotate the menu cases can facilitate switching the menu at any time. For example, a breakfast menu could be displayed on the front side of menu cases 106*a*, 106*b* while a lunch/dinner menu could be displayed on the back side. In this scenario, the menu could be quickly updated from breakfast to lunch/dinner by simply rotating menu cases 106*a*, 106*b*.

To ensure that menu cases 106*a*, 106*b* will remain oriented with the desired side in a forward facing position, each menu case can include angle stops 108*a*, 108*b*. Angle stops 108*a*, 108*b* can be secured to and extend downwardly from a bottom side of each menu case. The length of lower horizontal supports 105*a*, 105*b* can be less than the width of menu cases 106*a*, 106*b* so that the menu case is free to rotate through a 180° range.

Figure 2:
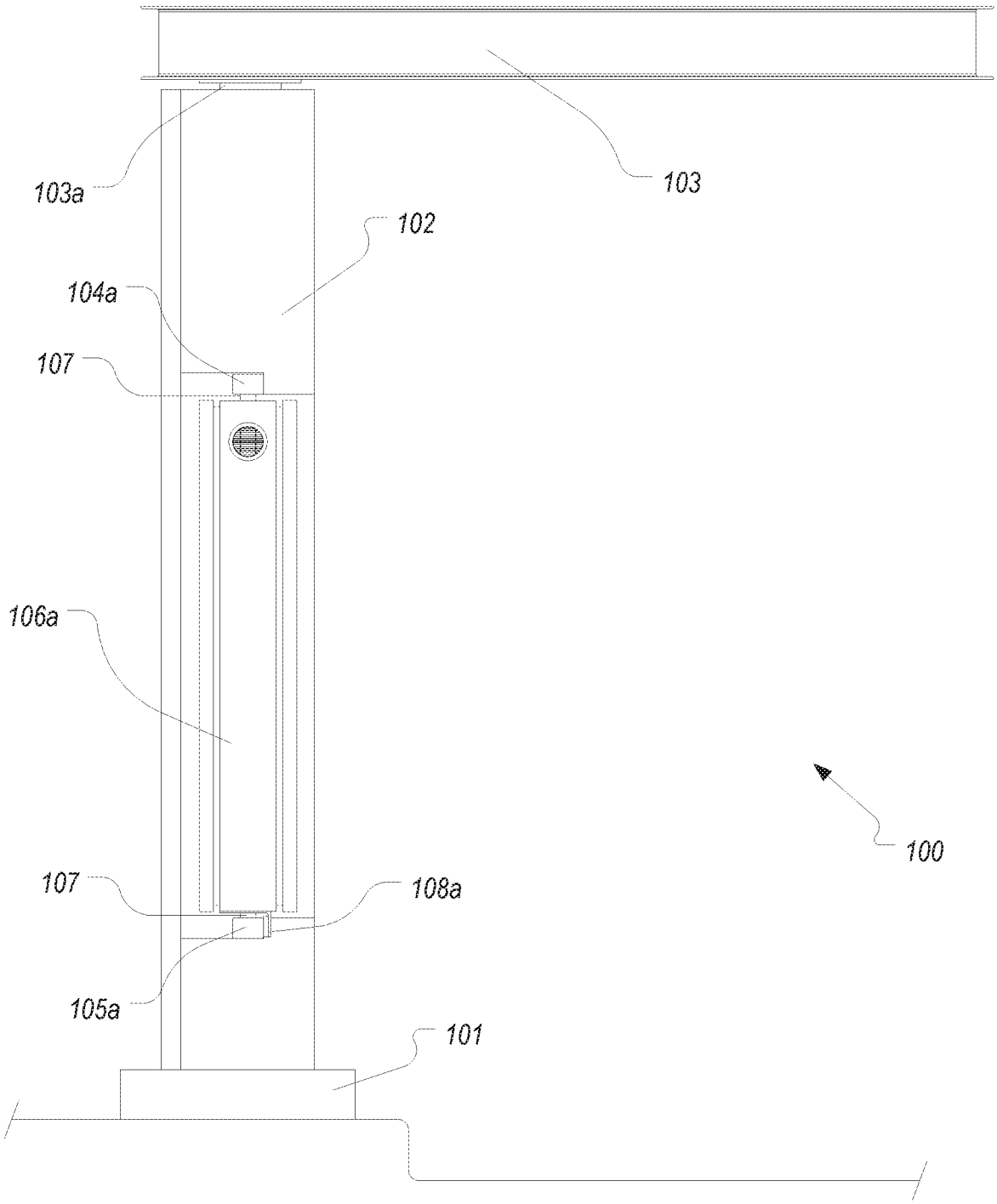
FIG. 2 provides a side view of the order point.

As is better shown in FIG. 2, angle stops 108*a*, 108*b* can both be oriented in the same direction. For example, in FIGS. 1 and 2, angle stops 108*a*, 108*b* are each facing backward. Also, the position of angle stops 108*a*, 108*b* relative to lower horizontal support 105*a*, 105*b* can be configured such that, when either of angle stops 108*a*, 108*b* contacts the lower horizontal support, the menu case will be oriented in alignment with the horizontal supports (i.e., oriented to face directly forward).

To ensure that the menu case will be oriented in alignment regardless of which side is facing forward, lower horizontal supports 105*a*, 105*b* can be symmetrically oriented with regards to the axis of rotation when viewed from the side. In particular, and with reference to FIG. 2, horizontal supports 105*a*, 105*b* can extend the same distance forward and backward from the axis of rotation. Both angle supports 108*a*, 108*b* can also be spaced an equal distance from the center plane of the menu case so that they will contact the lower horizontal support when the menu case is aligned with the lower horizontal support.

Figure 6:
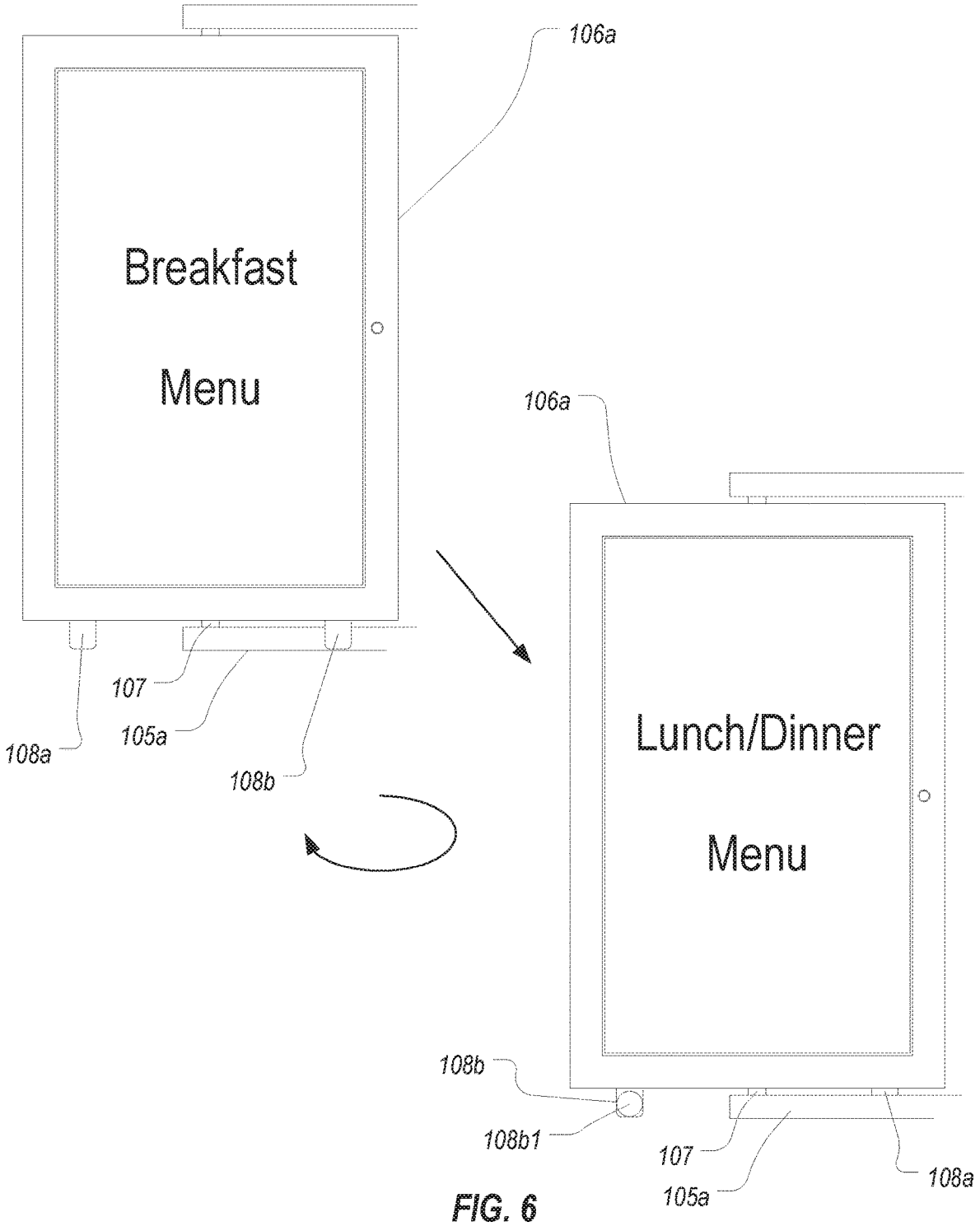
FIG. 6 provides a front view of a menu case illustrating how the menu case can be rotated to switch menus.
Figure 7:
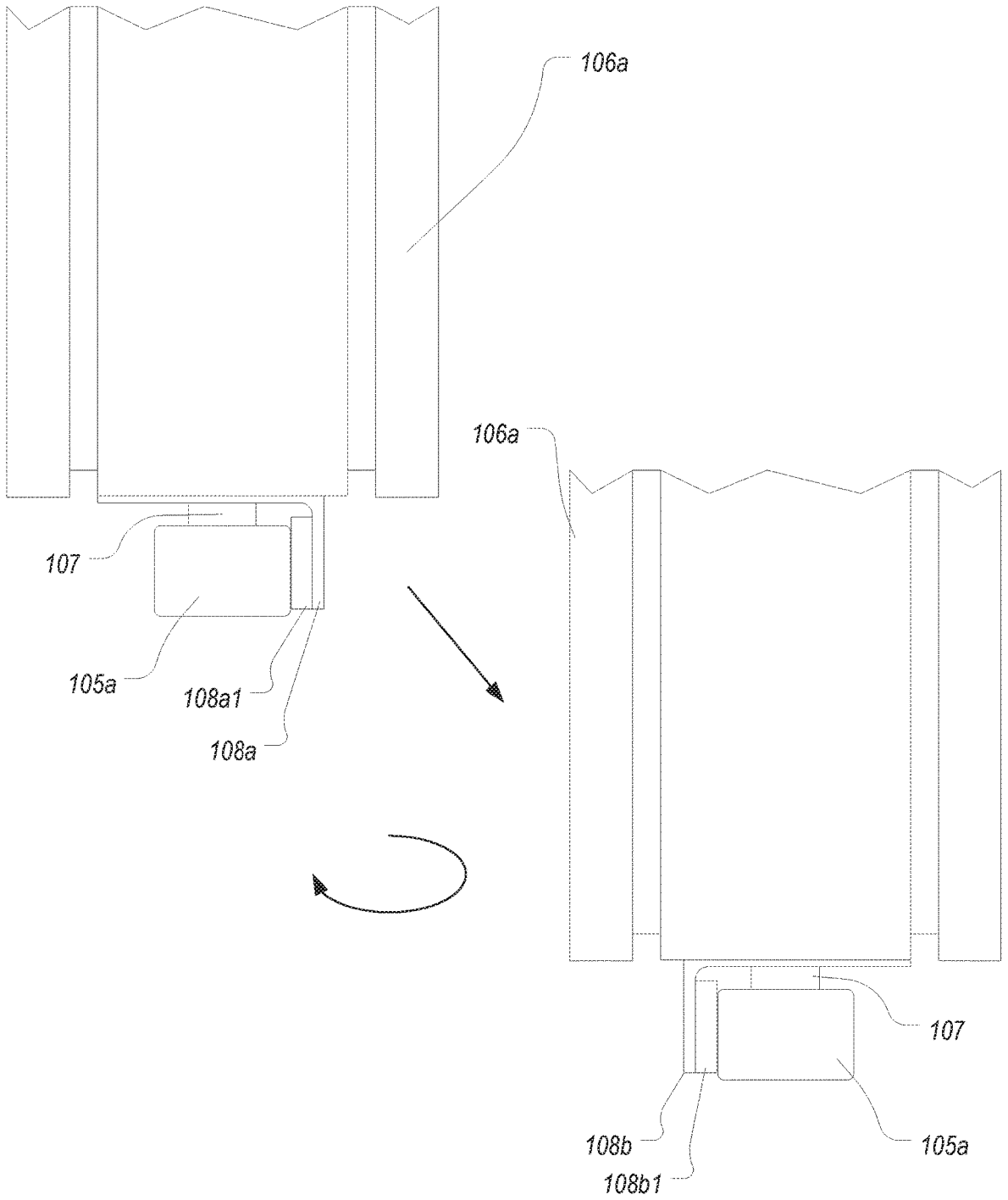
FIG. 7 provides a side view of a menu case illustrating how the menu case can be rotated to switch menus.

FIGS. 6 and 7 provide a more detailed example of how menu cases 106*a*, 106*b* can be rotated between the two forward facing positions. As shown in FIG. 6, it will be assumed that menu case 106*a* includes a breakfast menu-board on one side and a lunch/dinner menu-board on the other. The breakfast menu side represents the orientation of menu case 106*a* that is depicted in FIGS. 1 and 2. Accordingly, angle stops 108*a*, 108*b* are each facing backward when the breakfast menu is displayed with angle stop 108*b* contacting lower horizontal support 105*a* to orient menu case 106*a* in the forward facing position.

Each of angle stops 108*a*, 108*b* can include a magnet 108*a*1, 108*b*1 respectively (or other suitable coupling material) that will retain the angle stop against the lower horizontal support. As indicated above, when the breakfast menu is displayed on menu case 106*a*, magnets 108*a*1, 108*b*1 will be facing backward such that angle stop 108*b* will be secured to lower horizontal support 105*a*. The attraction force caused by magnet 108*b*1 can ensure that menu case 106*a* will not rotate unintentionally such as when the wind is blowing.

Then, when it is desired to display the lunch/dinner menu, menu case 106*a* can be rotated until angle stop 108*a* contacts lower horizontal support 105*a*. As angle stop 108*a* approaches lower horizontal support 105*a*, magnet 108*a*1 will pull angle stop 108*a*, and therefore menu case 106*a*, into a forward facing position and retain the menu case in that position.

Although the figures depict an embodiment where angle stops 108*a*, 108*b* are positioned below menu cases 106*a*, 106*b*, it is equally possible to position angle stops 108*a*, 108*b* above menu cases 106*a*, 106*b* such that they contact upper horizontal support 104*a*, 104*b* to perform the same function described above. Also, although the figures depict an embodiment of an order point that includes two menu cases, an order point configured in accordance with embodiments of the present invention may equally include a single menu case. For example, horizontal supports 104*b*, 105*b* and menu case 106*b* could be removed from order point 100 such that only menu case 106*a* is provided.

Also, although order point 100 is shown as including rotatable menu cases, in some embodiments, an order point may include fixed menu cases. For example, in some cases, an establishment may not need to display additional menus and therefore may not desire to rotate the menu cases. In such cases, menu cases 106*a*, 106*b* could be secured to the horizontal supports in a fixed (i.e., non-rotatable) manner and may not include angle stops 108*a*, 108*b*. In all other regards, these fixed-menu-case order points can be configured in the same manner as order point 100.

Figure 8:
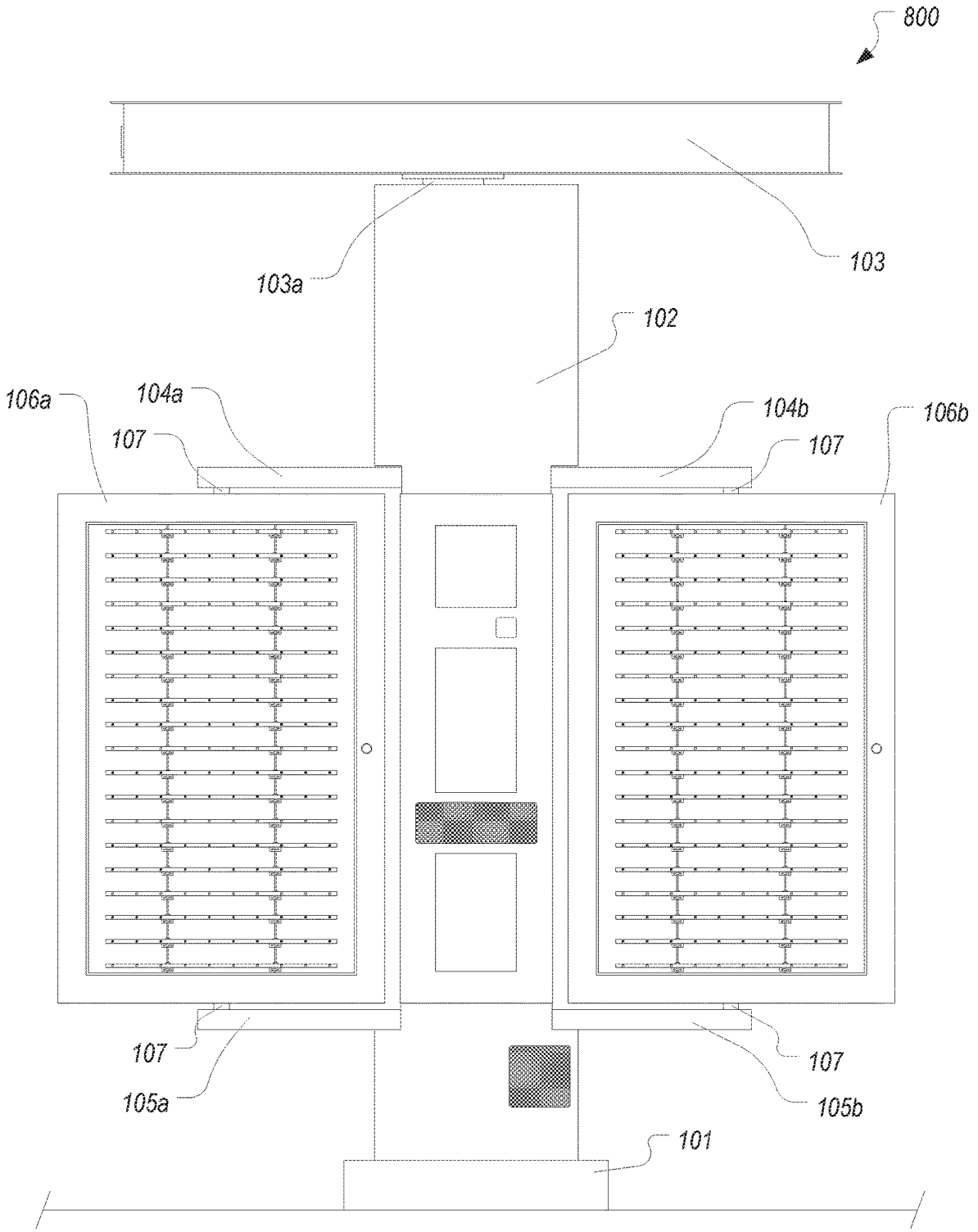
FIG. 8 illustrates an order point that includes fixed menu cases.

FIG. 8 illustrates an example of an order point 800 in which menu cases 106*a*, 106*b* are fixed. As shown, menu cases 106*a*, 106*b* do not include angle stops 108*a*, 108*b* but otherwise, order point 800 is configured in the same manner as order point 100. Notably, order point 800 includes a base 101, a vertical support 102 housing a speaker, microphone, and camera, horizontal supports 104*a*, 104*b*, 105*a*, 105*b* which support menu cases 106*a*, 106*b*, and canopy 103 that is secured to vertical support 102 via pivoting connection 103*a*.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. An order point comprising:

a base;

a vertical support extending upwardly from the base;

first and second horizontal supports that each extend outwardly from a first side of the vertical support, the first horizontal support being spaced from the second horizontal support;

a first menu case having a first side and a second side opposite the first side, the first menu case being secured between the first and second horizontal supports via a rotatable connection allowing the menu case to rotate about a vertical axis, the first menu case including a first angle stop that contacts the second horizontal support when the first menu case is rotated about the vertical axis to cause the first side of the menu case to be facing forward toward a first drive-through lane and a second angle stop that contacts the second horizontal support when the first menu case has been rotated to cause the second side to be facing toward the second drive-through lane; and a canopy coupled to a vertical support by a pivoting connection so that the canopy rotates when the canopy is contacted by a vehicle, shock absorbing material coating configured to minimize damage to the canopy when the canopy is encountered by a vehicle, and wherein the canopy is set at a height corresponding to the height of a structure under which a vehicle must pass in a drive-through lane, the canopy being positioned overtop the first menu case, and biased to return to the canopy's original position after contact with a vehicle;

lights positioned on the underside of the canopy to illuminate the ground around the order point; and a light curtain extending vertically between the center of the first menu case and the second menu case to provide illumination to both the first menu case and the second menu case.

2. The order point of claim 1, wherein the second horizontal support is positioned below the first horizontal support.

3. The order point of claim 1, wherein each of the first and second angle stops are oriented to face in the same direction.

4. The order point of claim 1, wherein each of the first and second angle stops include a magnet that secures the angle stop to the second horizontal support.

5. The order point of claim 1, wherein the rotatable connection comprises one or more posts that insert into the first menu case at a point of symmetry of the first menu case.

6. The order point of claim 1, wherein the second horizontal support has a length that causes an outer end of the second horizontal support to be positioned inside one of the first or second angle stops when the other of the first or second angle stops contacts the second horizontal support.

7. The order point of claim 1, further comprising:

third and fourth horizontal supports that each extend outwardly from a second side of the vertical support opposite the first side of the vertical support, the third horizontal support being spaced from the fourth horizontal support;

a second menu case having a first side and a second side opposite the first side, each of the first and second sides of the second menu case being configured to display a menu, the second menu case being secured between the third and fourth horizontal supports via a rotatable connection, the second menu case including a third angle stop that contacts the fourth horizontal support when the second menu case has been rotated to cause the first side to be facing forward and a fourth angle stop that contacts the fourth horizontal support when the second menu case has been rotated to cause the second side to be facing forward.

8. The order point of claim 7, wherein the fourth horizontal support is positioned below the third horizontal support.

9. An order point comprising:

a base;

a vertical support extending upwardly from the base;

first and second upper horizontal supports that extend from opposite sides of the vertical support;

first and second lower horizontal supports that also extend from opposite sides of the vertical support;

a first menu case secured between the first upper horizontal support and the first lower horizontal support via a rotatable connection, the first menu case having a first side and a second side opposite the first side, each of the first and second sides being configured to display a menu so that a menu is visible from the front and back of the menu case, the first menu case including a first angle stop that contacts either the first lower horizontal support or the first upper horizontal support when the first menu case has been rotated about a vertical axis to cause the first side to be facing forward toward a first drive-through lane and a second angle stop that contacts either the first lower horizontal support or the first upper horizontal support when the first menu case has been rotated to cause the second side to be facing forward;

a second menu case secured between the second upper horizontal support and the second lower horizontal support via a rotatable connection, the second menu case having a first side and a second side opposite the first side, each of the first and second sides of the second menu case being configured to display a menu, the second menu case including a third angle stop that contacts either the second lower horizontal support or the second upper horizontal support when the second menu case has been rotated to cause the first side to be facing forward and a fourth angle stop that contacts either the second lower horizontal support or the second upper horizontal support when the second menu case has been rotated to cause the second side to be facing toward the second drive-through lane; and a canopy coupled to a vertical support by a pivoting connection so that the canopy rotates when the canopy is contacted by a vehicle, shock absorbing material lining configured to minimize damage to the canopy when the canopy is encountered by a vehicle, and wherein the canopy is set at a height corresponding to the height of a structure under which a vehicle must pass in a drive-through lane, the canopy being positioned overtop the first menu case, and biased to return to the canopy's original position after contact with a vehicle;

lights positioned on the underside of the canopy to illuminate the ground around the order point; and a light curtain extending vertically between the center of the first menu case and the second menu case to provide illumination to both the first menu case and the second menu case.

10. The order point of claim 9, wherein each of the angle stops includes a magnet to secure the angle stop to the corresponding horizontal support.

11. The order point of claim 9, wherein:

the first menu case extends outwardly beyond the first upper horizontal support and the first lower horizontal support when either the first or second side of the first menu case is facing forward; and the second menu case extends outwardly beyond the second upper horizontal support and the second lower horizontal support when either the first or second side of the second menu case is facing forward.

12. The order point of claim 11, wherein:

one of the first or second angle stops is positioned outwardly beyond the first upper horizontal support or the first lower horizontal support when the other of the first or second angle stop contacts either the first upper horizontal support or the first lower horizontal support; and one of the third or fourth angle stops is positioned outwardly beyond the second upper horizontal support or the second lower horizontal support when the other of the third or fourth angle stop contacts either the second upper horizontal support or the second lower horizontal support.

* * * * *